US009587820B2

(12) United States Patent
Udris et al.

(10) Patent No.: US 9,587,820 B2
(45) Date of Patent: Mar. 7, 2017

(54) ACTIVE COOLING DEVICE

(71) Applicant: GE Lighting Solutions, LLC, East Cleveland, OH (US)

(72) Inventors: Karl Kristian Udris, Cleveland, OH (US); Glenn Howard Kuenzler, Beachwood, OH (US); Jeremias Anthony Martins, Twinsburgh, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 56 days.

(21) Appl. No.: 13/710,782

(22) Filed: Dec. 11, 2012

(65) Prior Publication Data

US 2013/0294069 A1 Nov. 7, 2013

Related U.S. Application Data

(63) Continuation-in-part of application No. 13/665,959, filed on Nov. 1, 2012.

(Continued)

(51) Int. Cl.

| | |
|---|---|
| ***F21V 29/00*** | (2015.01) |
| ***F28F 7/00*** | (2006.01) |
| ***F24H 3/06*** | (2006.01) |
| ***F28F 13/12*** | (2006.01) |
| ***F21V 29/60*** | (2015.01) |

(Continued)

(52) U.S. Cl.

CPC ..... *F21V 29/60* (2015.01); *F21K 9/232* (2016.08); *F21V 29/63* (2015.01); *F21V 29/74* (2015.01); *F21V 29/83* (2015.01); *F28F 13/12* (2013.01); *F21V 23/006* (2013.01); *F21V 29/02* (2013.01);

(Continued)

(58) Field of Classification Search

CPC ..... B06B 1/04; H01L 23/473
USPC ..... 362/249.02, 373, 294, 264, 218; 165/80.3, 122

See application file for complete search history.

(56) References Cited

U.S. PATENT DOCUMENTS 3,180,981 A 4/1965 Ulffers
3,341,689 A * 9/1967 Reichenbach ..... 392/365

(Continued)

FOREIGN PATENT DOCUMENTS

DE 202012101158 U1 4/2012
EP 2233832 A1 9/2010

(Continued)

OTHER PUBLICATIONS

PCT Search Report and Written Opinion dated Feb. 4, 2014 from corresponding Application No. PCT/US2013/067973.

(Continued)

*Primary Examiner* — Andrew Coughlin
*Assistant Examiner* — Alexander Garlen
(74) *Attorney, Agent, or Firm* — GE Global Patent Operation; Peter T. DiMauro

(57) ABSTRACT

An active cooling device in the form of a torsional, oscillating synthetic jet is provided. Fins are oscillated in a manner that creates a flow of air that can be used to cool an electronic device such as a lamp. Embodiments of the active cooling device can be compact and readily incorporated within heat sinks of different sizes and configurations. The flow of air can be provided as jets of air distributed over multiple directions as may be desirable with certain electronics such as an omnidirectional lamp.

19 Claims, 9 Drawing Sheets

Related U.S. Application Data

(60) Provisional application No. 61/643,056, filed on May 4, 2012.

(51) Int. Cl.

| | |
|---|---|
| ***F21V 29/74*** | (2015.01) |
| ***F21V 29/63*** | (2015.01) |
| ***F21V 29/83*** | (2015.01) |
| *F21V 29/02* | (2006.01) |
| *F21V 23/00* | (2015.01) |
| *F21V 29/75* | (2015.01) |
| *F21V 29/77* | (2015.01) |
| *F21Y 101/00* | (2016.01) |

(52) U.S. Cl.
CPC ..... *F21V 29/75* (2015.01); *F21V 29/773* (2015.01); *F21Y 2101/00* (2013.01)

(56) References Cited

U.S. PATENT DOCUMENTS

| | | | | |
|---|---|---|---|---|
| 4,120,565 | A | 10/1978 | Rabl et al. | |
| 5,335,157 | A | 8/1994 | Lyons | |
| 5,405,251 | A | 4/1995 | Sipin | |
| 5,906,429 | A | 5/1999 | Mori et al. | |
| 6,142,652 | A | 11/2000 | Richardson | |
| 6,350,041 | B1 | 2/2002 | Tarsa et al. | |
| 6,767,111 | B1 | 7/2004 | Lai | |
| 6,814,470 | B2 | 11/2004 | Rizkin et al. | |
| 6,833,565 | B2 | 12/2004 | Su et al. | |
| 6,864,513 | B2 | 3/2005 | Lin et al. | |
| D508,575 | S | 8/2005 | Buschmann et al. | |
| 6,932,496 | B2 | 8/2005 | Rizkin et al. | |
| 7,086,756 | B2 | 8/2006 | Maxik | |
| D528,227 | S | 9/2006 | Chou et al. | |
| D531,741 | S | 11/2006 | Takahashi | |
| 7,144,140 | B2 | 12/2006 | Sun et al. | |
| D534,665 | S | 1/2007 | Egawa et al. | |
| 7,204,615 | B2 | 4/2007 | Arik et al. | |
| 7,223,000 | B2 | 5/2007 | Yamamura | |
| 7,258,464 | B2 * | 8/2007 | Morris et al. | 362/264 |
| 7,434,964 | B1 | 10/2008 | Zheng et al. | |
| 7,581,856 | B2 | 9/2009 | Kang et al. | |
| 7,637,639 | B2 | 12/2009 | Epstein | |
| 7,760,499 | B1 | 7/2010 | Darbin et al. | |
| 7,784,972 | B2 | 8/2010 | Heffington et al. | |
| 7,837,363 | B2 | 11/2010 | Liu | |
| 7,932,535 | B2 | 4/2011 | Mahalingam et al. | |
| 8,030,886 | B2 | 10/2011 | Mahalingam et al. | |
| 8,035,966 | B2 | 10/2011 | Reichenbach et al. | |
| 8,057,071 | B2 | 11/2011 | He et al. | |
| 8,057,075 | B2 | 11/2011 | Horng et al. | |
| 8,066,410 | B2 | 11/2011 | Booth et al. | |
| D653,365 | S | 1/2012 | Yuan et al. | |
| 8,094,393 | B2 | 1/2012 | Minano et al. | |
| 8,115,395 | B2 | 2/2012 | Horng et al. | |
| 8,136,576 | B2 | 3/2012 | Grimm | |
| 8,152,318 | B2 | 4/2012 | Richardson | |
| D658,788 | S | 5/2012 | Dudik et al. | |
| D660,991 | S | 5/2012 | Allen et al. | |
| 8,246,202 | B2 | 8/2012 | Mart et al. | |
| 8,299,691 | B2 | 10/2012 | Grimm | |
| 8,314,537 | B2 | 11/2012 | Gielen et al. | |
| 8,414,160 | B2 | 4/2013 | Sun et al. | |
| 8,541,932 | B2 | 9/2013 | Horng | |
| 8,602,607 | B2 | 12/2013 | Arik et al. | |
| 8,608,347 | B2 | 12/2013 | Chinniah et al. | |
| 8,845,138 | B2 | 9/2014 | Booth et al. | |
| 2005/0174780 | A1 | 8/2005 | Park | |
| 2007/0147046 | A1 * | 6/2007 | Arik et al. | 362/294 |
| 2007/0159828 | A1 | 7/2007 | Wang | |
| 2007/0165411 | A1 | 7/2007 | Abdelsamed | |
| 2008/0009187 | A1 | 1/2008 | Grimm et al. | |
| 2009/0084866 | A1 | 4/2009 | Grimm et al. | |
| 2009/0148320 | A1 | 6/2009 | Lucas | |
| 2009/0225430 | A1 | 9/2009 | Barnes et al. | |
| 2010/0053963 | A1 | 3/2010 | Yang et al. | |
| 2010/0123397 | A1 | 5/2010 | Tian et al. | |
| 2010/0170657 | A1 | 7/2010 | Kaslusky | |
| 2011/0037387 | A1 | 2/2011 | Chou et al. | |
| 2011/0063800 | A1 * | 3/2011 | Park | 361/697 |
| 2011/0080096 | A1 | 4/2011 | Dudik et al. | |
| 2011/0080740 | A1 | 4/2011 | Allen et al. | |
| 2011/0089804 | A1 | 4/2011 | Mahalingam et al. | |
| 2011/0089830 | A1 | 4/2011 | Pickard et al. | |
| 2011/0122582 | A1 | 5/2011 | Park et al. | |
| 2011/0128742 | A9 | 6/2011 | Yuen et al. | |
| 2011/0128746 | A1 | 6/2011 | Zheng | |
| 2011/0140148 | A1 | 6/2011 | Liu | |
| 2011/0140149 | A1 | 6/2011 | Liu et al. | |
| 2011/0156584 | A1 | 6/2011 | Kim | |
| 2011/0162823 | A1 | 7/2011 | Sharma et al. | |
| 2011/0169394 | A1 | 7/2011 | Chowdhury et al. | |
| 2011/0170299 | A1 | 7/2011 | Takase et al. | |
| 2011/0204790 | A1 | 8/2011 | Arik et al. | |
| 2011/0215345 | A1 | 9/2011 | Tarsa et al. | |
| 2011/0215698 | A1 | 9/2011 | Tong et al. | |
| 2011/0242816 | A1 | 10/2011 | Chowdhury et al. | |
| 2011/0242817 | A1 | 10/2011 | Chowdhury et al. | |
| 2011/0286200 | A1 | 11/2011 | Iimura et al. | |
| 2012/0008330 | A1 | 1/2012 | Horng et al. | |
| 2012/0026740 | A1 | 2/2012 | Kim et al. | |
| 2012/0051058 | A1 * | 3/2012 | Sharma et al. | 362/294 |
| 2012/0051088 | A1 | 3/2012 | Chui et al. | |
| 2012/0080669 | A1 | 4/2012 | Yamazaki et al. | |
| 2012/0080699 | A1 | 4/2012 | Chowdhury et al. | |
| 2012/0140486 | A1 | 6/2012 | Chou | |
| 2012/0161626 | A1 | 6/2012 | Van De Ven et al. | |
| 2012/0182711 | A1 | 7/2012 | Kolodin et al. | |
| 2012/0194054 | A1 | 8/2012 | Johnston et al. | |
| 2012/0218768 | A1 | 8/2012 | Hisano et al. | |
| 2012/0262915 | A1 | 10/2012 | Lin et al. | |
| 2013/0176721 | A1 | 7/2013 | Lu et al. | |
| 2013/0176722 | A1 | 7/2013 | Lay et al. | |
| 2013/0201680 | A1 | 8/2013 | Allen et al. | |
| 2013/0294086 | A1 | 11/2013 | Mayer et al. | |

FOREIGN PATENT DOCUMENTS

| | | | |
|---|---|---|---|
| GB | 2195047 | A | 3/1988 |
| JP | S62199999 | A | 9/1987 |
| JP | H01233796 | A | 9/1989 |
| JP | 2000304908 | A | 11/2000 |
| JP | 2003346526 | A | 12/2003 |
| WO | 2009071111 | A1 | 6/2009 |
| WO | 2010146518 | A1 | 12/2010 |
| WO | 2011089103 | A1 | 7/2011 |
| WO | 2011159961 | A1 | 12/2011 |
| WO | 2012084674 | A1 | 6/2012 |

OTHER PUBLICATIONS

US Final Office Action issued in connection with related U.S. Appl. No. 13/706,798 on Jun. 10, 2015.

European Office Action issued in connection with related Application No. 13719685.3 on Jan. 18, 2016.

European Office Action issued in connection with related Application No. 13724956.1 on Jan. 29, 2016.

Cree, "Cree® XLamp® XB-D LED 75-watt Equivalent A19 Lamp Reference Design", pp. 1-15, 2012.

Jiang et al., "TIR Optics Enhance the Illuminance on Target for Directional LED Modules", LEDs Magazine, http://ledsmagazine.com/features/9/2/8, Feb. 2012.

PCT Search Report and Written Opinion issued in connection with corresponding Application No. PCT/US2013/037556 on Jul. 12, 2013.

PCT Search Report and Written Opinion issued in connection with corresponding Application No. PCT/US2013/039482 on Jul. 25, 2013.

PCT Search Report and Written Opinion issued in connection with corresponding Application No. PCT/US2013/039513 on Jul. 25, 2013.

(56) References Cited

OTHER PUBLICATIONS

PCT Search Report and Written Opinion issued in connection with corresponding Application No. PCT/US2013/039464 on Aug. 1, 2013.
US Non-Final Office Action issued in connection with related U.S. Appl. No. 14/398,887 on Sep. 19, 2016.
US Non-Final Office Action issued in connection with Related U.S. Appl. No. 14/536,957 on Oct. 19, 2016.

* cited by examiner

ACTIVE COOLING DEVICE

PRIORITY CLAIM

This application claims benefit of priority from earlier filed, commonly owned, copending U.S. Provisional Patent Application 61/643,056, filed May 4, 2012, which is hereby incorporated by reference. This application also claims benefit of priority from earlier filed, commonly owned, copending U.S. patent application Ser. No. 13/665,959, filed Nov. 1, 2012, which is also hereby incorporated by reference.

FIELD OF THE INVENTION

The subject matter of the present disclosure relates generally to an active cooling device in the form of a torsional oscillating synthetic jet that can be used e.g., to cool electronic devices including lamps, circuit boards, and others.

BACKGROUND OF THE INVENTION

Electronic devices can generate significant heat during use. Part of the electrical energy used to operate the device may be converted into heat energy. Depending upon the amount of heat energy created and the construction of the device, it may be necessary to provide for the dissipation of the heat energy to prevent damage to the device and/or provide for proper operation.

By way of example, lamps or other electronic devices that include solid state light emitting sources such as e.g., light emitting diodes (LEDs) can provide certain advantages over incandescent type lamps including better energy efficiency and longer life, but these light sources typically require management of certain heat related issues. The junction temperature for a typical LED device, for example, should be below 150° C. and in some LED devices should be below 100° C. or even lower. At these low operating temperatures, radiative heat transfer to the surrounding environment is weak compared with that of conventional light sources.

With electronic devices such as LED light sources that need heat management, the convective and radiative heat transfer to the environment can be enhanced by the addition of a heat sink. A heat sink is a component providing a large surface for radiating and convecting heat away from the electronic device. In a typical design, the heat sink is a relatively massive metal element having a large engineered surface area, for example, by having fins or other heat dissipating structures on its outer surface. Where equipped with a large surface area, the heat fins can provide heat egress by radiation and convection.

However, even with the use of a heat sink, significant challenges remain for sufficient heat dissipation from an electronic device such as e.g., a lamp. For example, depending upon the amount of light intensity desired, multiple light emitting devices such as LEDs may be desirable. Depending upon e.g., the number of such light emitting devices that are employed, the total thermal power, and other factors, the heat sink alone may not be able to adequately dissipate heat from the lamp through passive means. While increasing the size of the heat sink could improve the dissipation of heat, such may be undesirable because it may also increase the overall size of the electronic device. For example, increasing the size of a heat sink used with a lamp may cause the lamp to exceed specifications for form such as e.g., the ANSI A19 profile.

Additionally, some light emitting devices have directional limitations that also present challenges for lamp design. For example, LED devices are usually flat-mounted on a circuit board such that the light output is substantially along a line perpendicular to the plane of the circuit board. Thus, a flat LED array typically does not provide a uniformly distributed, omnidirectional light output that may be desirable for many lamp applications, However, the ability to arrange LEDs so as to provide a more uniformly distributed light output can also be limited by heat management issues that can negatively affect the arrangement that is otherwise optimal for light distribution.

Another challenge relates to aesthetics. An electronic device such as a lamp that is designed only with consideration of performance requirements regarding light output, energy usage, thermal management, etc. may not provide an appearance that is pleasing to e.g., certain consumers. Such can affect the marketability of lamp even if it otherwise performs well.

Accordingly, an active cooling device that can provide cooling for electronic devices such as e.g., lamps, circuit boards, and others would be useful. Such a device that can also be used compactly and/or discreetly—i.e. without undesirably increasing the size of the electronic device or negatively affecting the aesthetics of the device would also be useful.

BRIEF DESCRIPTION OF THE INVENTION

The present invention provides an active cooling device in the form of a torsional, oscillating synthetic jet. Fins are oscillated in a manner that creates a flow of air that can be used to cool an electronic device such as a lamp. Embodiments of the active cooling device can be compact and readily incorporated within heat sinks of different sizes and configurations. The flow of air can be provided as jets of air distributed over multiple directions as may be desirable with certain electronics such as an omnidirectional lamp. Additional aspects and advantages of the invention will be set forth in part in the following description, or may be apparent from the description, or may be learned through practice of the invention.

In one exemplary embodiment, the present invention provides an active cooling device. The active cooling device defines radial and circumferential directions. The active cooling device includes a plurality of fins spaced apart from each other along a circumferential direction of the cooling device and rotatable about an axis of rotation. A housing defines a plurality of chambers positioned adjacent to each other along the circumferential direction, each chamber defining at least two openings for air flow in and out of the chamber, wherein at least one fin from the plurality of fins is movably positioned within each chamber. An oscillating device is positioned at least partially within the housing and radially inward of the plurality of fins. The plurality of fins are connected with the oscillating device. The oscillating device is structured for causing the plurality of fins to rotate back and forth along the circumferential direction so as to create air flow through the openings in each chamber.

In another exemplary embodiment, the present invention includes a lamp that incorporates such exemplary active cooling device.

In still another exemplary embodiment, the present invention provides an active cooling device. The device includes a housing defining an internal compartment and a plurality of chambers positioned proximate to each other along a circumferential direction. The plurality of chambers are positioned radially outward of the internal compartment. Each chamber of the plurality of chambers has at least two openings spaced apart from each other along the circumferential direction. A plurality of fins are mechanically connected to each other with each fin positioned in one of the plurality of chambers. The plurality of fins are rotatable within the plurality of chambers and about an axis of rotation so as to create a flow of air through the at least two openings. An oscillating device is positioned at least partially within the internal compartment of the housing and radially inward of the plurality of fins. The plurality of fins are connected with the oscillating device. The oscillating device is structured for causing the plurality of fins to rotate back and forth along the circumferential direction so as to create air flow through the openings in each chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
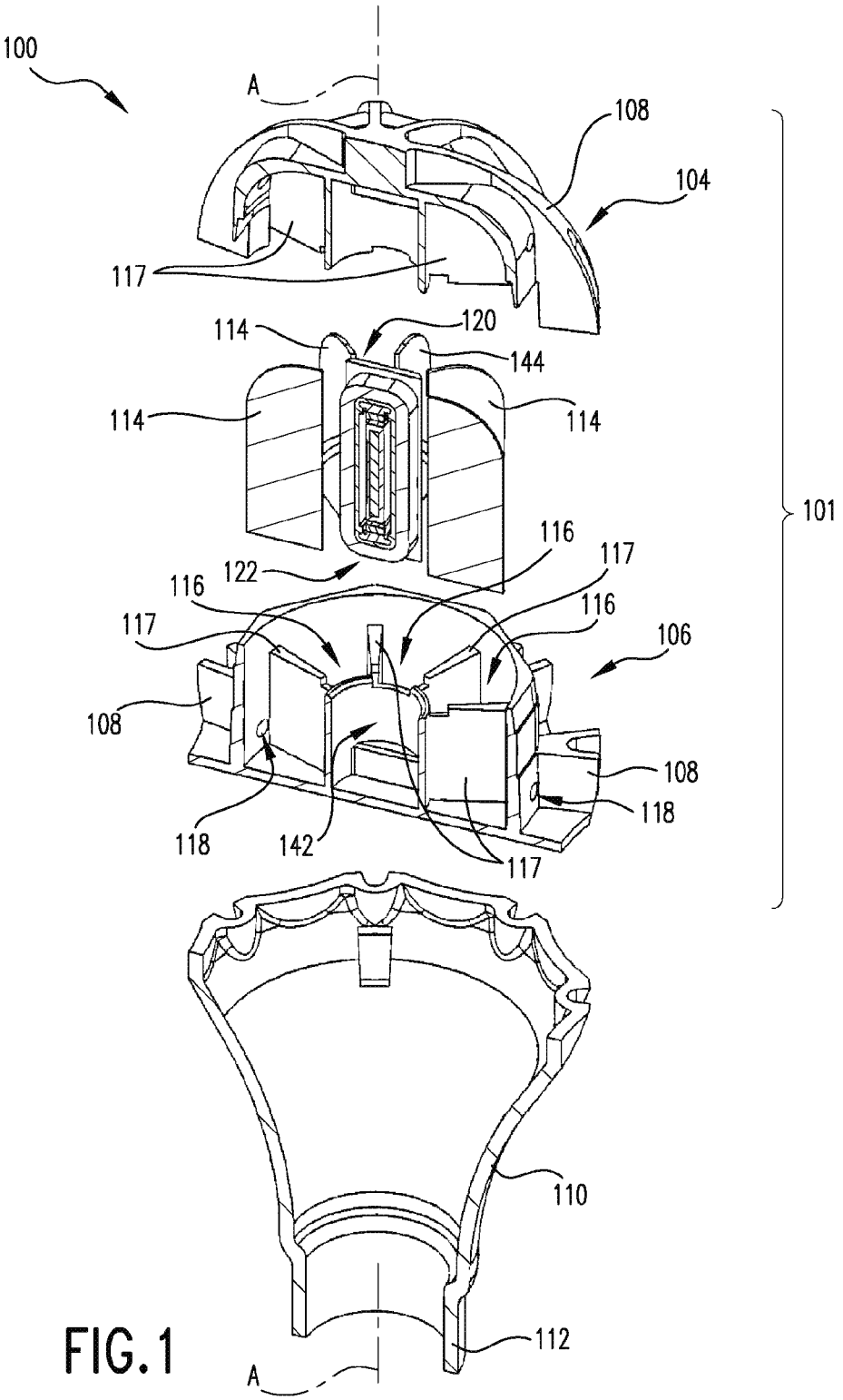
FIG. 1 provides an exploded and cross-sectional view of an exemplary embodiment of a lamp incorporating an exemplary active cooling device of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
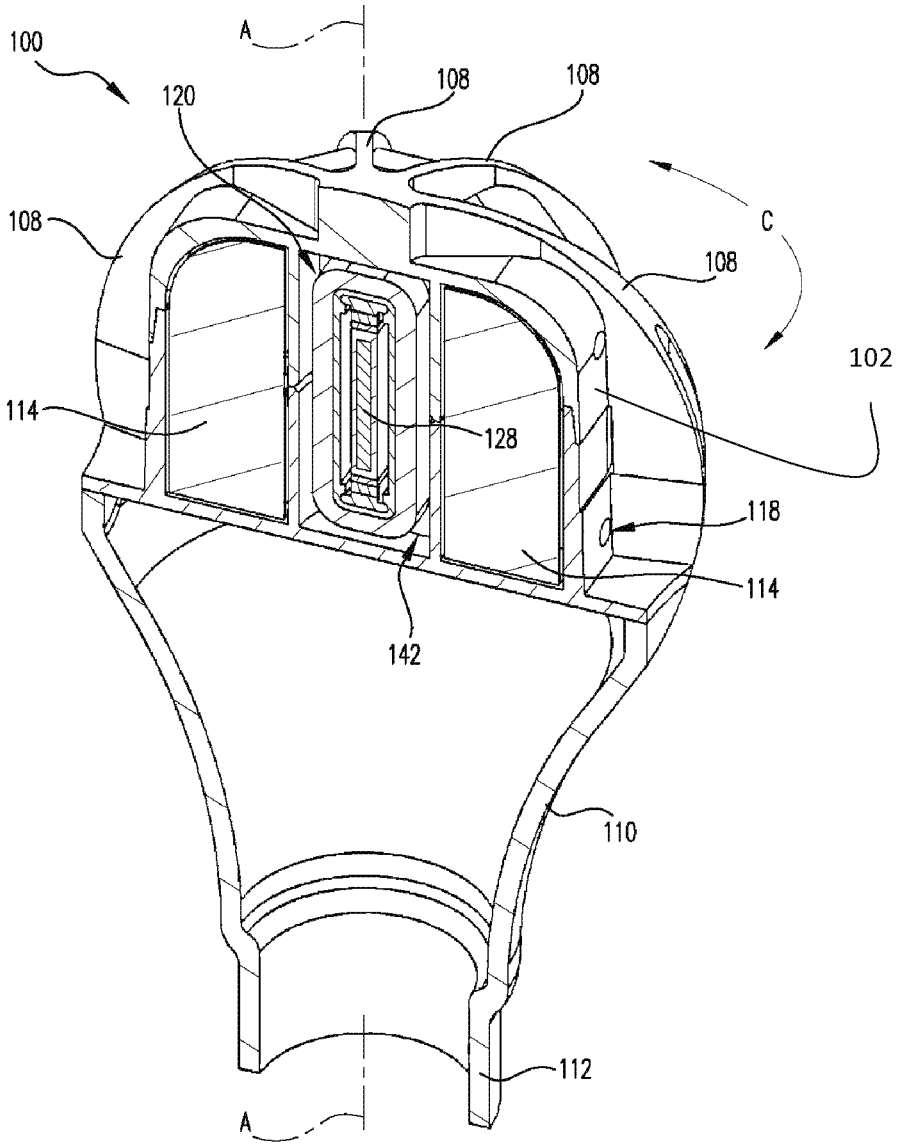
FIG. 2 is a partial cross-sectional and perspective view of the exemplary lamp with the exemplary active cooling device of FIG. 1.

FIG. 1 illustrates a cross-sectional, exploded view of an exemplary lamp 100 incorporating an exemplary embodiment of an active cooling device 101 of the present invention. FIG. 2 provides a perspective and cross-sectional view of lamp 100. Although described in conjunction with lamp 100, one of skill in the art using the teachings disclosed herein will understand that active cooling device 100 (or other embodiments thereof) could be used to provide cooling for other electronic devices including e.g., printed circuit boards, computers or computer components, and other devices as well.

Active cooling device 101 includes a housing 102 (FIG. 2) that operates as a heat sink for lamp 100. Housing 102 is constructed from an upper portion 104 and a lower portion 106 (FIG. 1) that are joined together. Housing 102 includes a plurality of stationary fins 108 positioned separately from each other along circumferential direction C. Fins 108 can improve the ability of housing 102 to dissipate heat. The shape of housing 102 including fins 108 is provided by way of example only. Other housings of different shapes and configurations may be used with active cooling device 101 as well depending upon the application. For example, where used with a lamp, housing 102 may be provided with aesthetic features that provide a different appearance for lamp 100.

Figure 3:
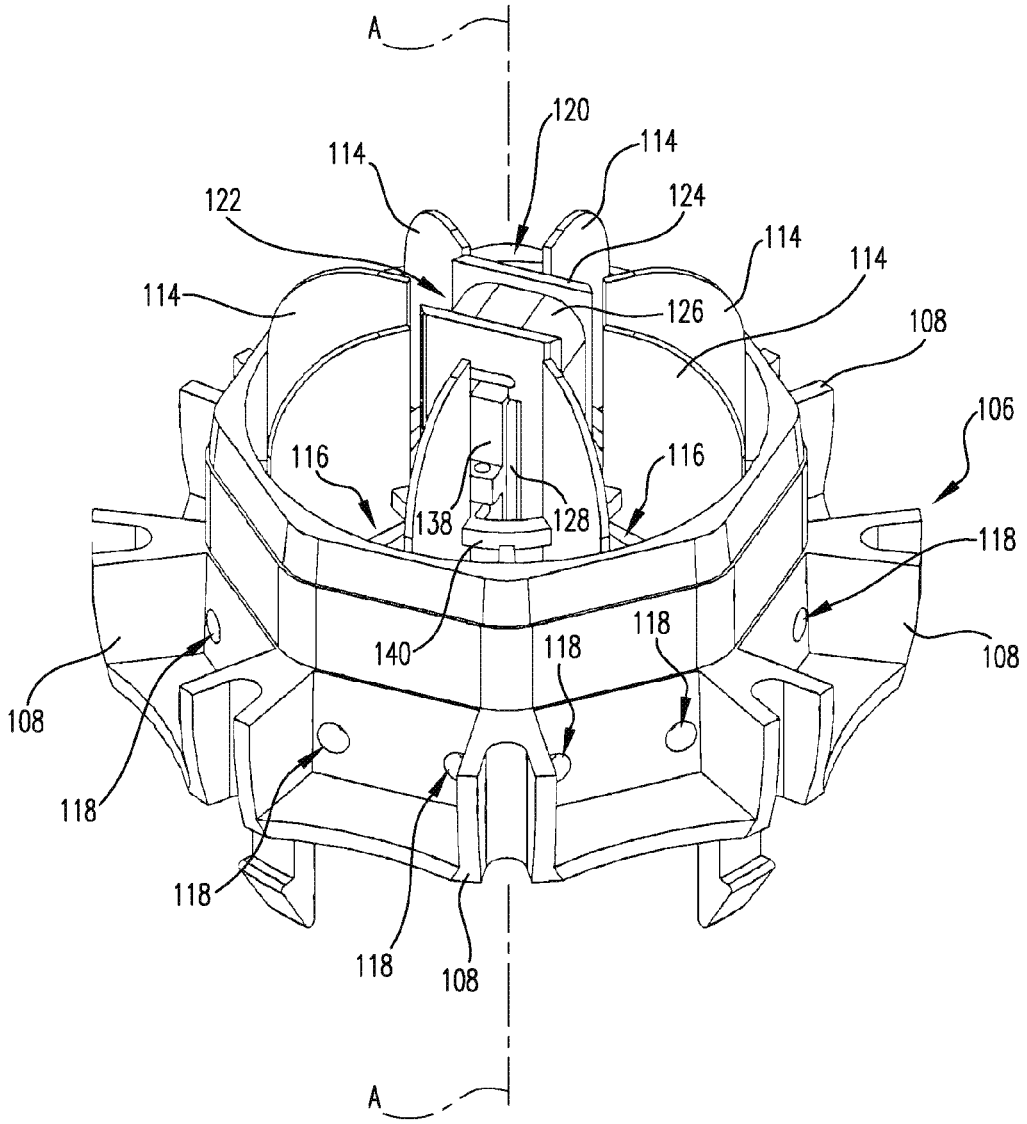
FIG. 3 is a perspective view of the exemplary active cooling device of FIG. 1 shown in a portion of an exemplary heat sink as used in the embodiment of FIG. 1.
Figure 4:
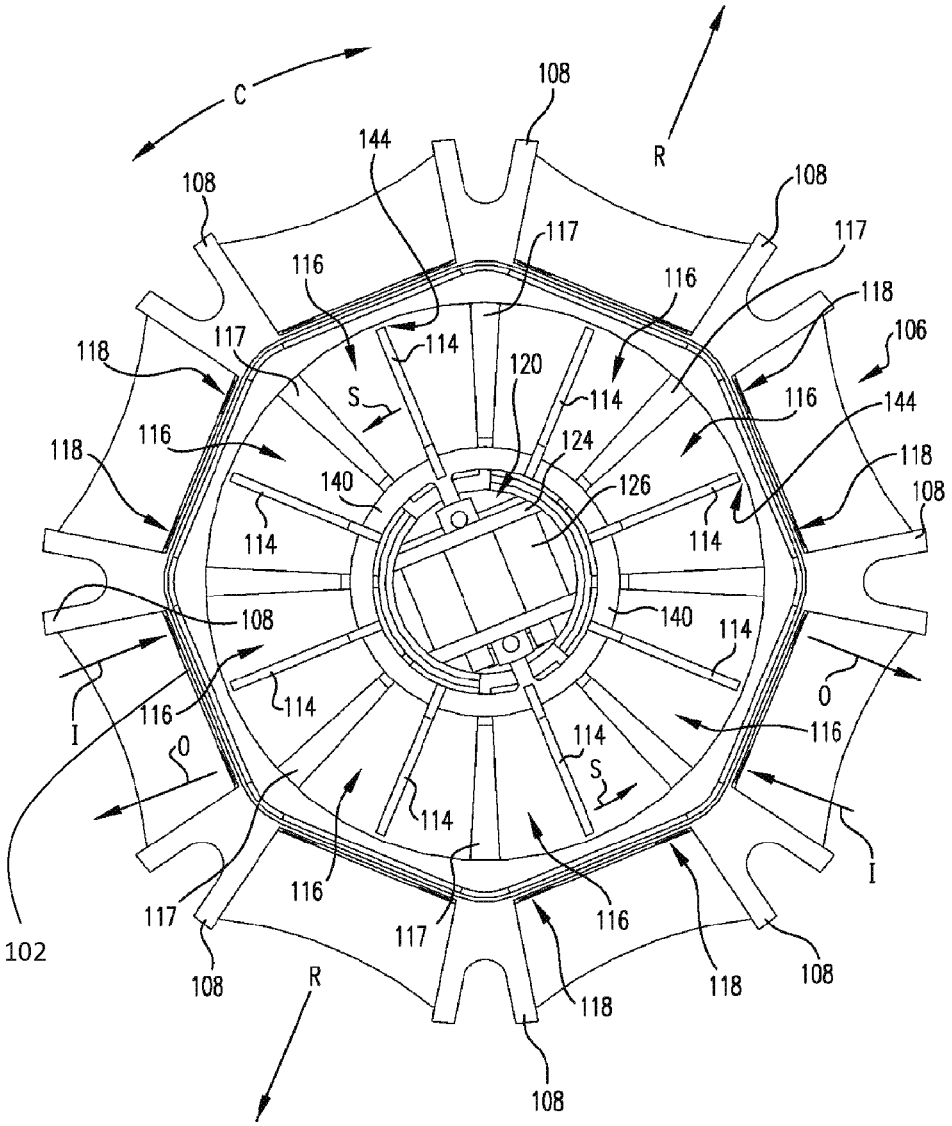
FIG. 4 is a top view of the exemplary assembly shown in FIG. 3.
Figure 5:
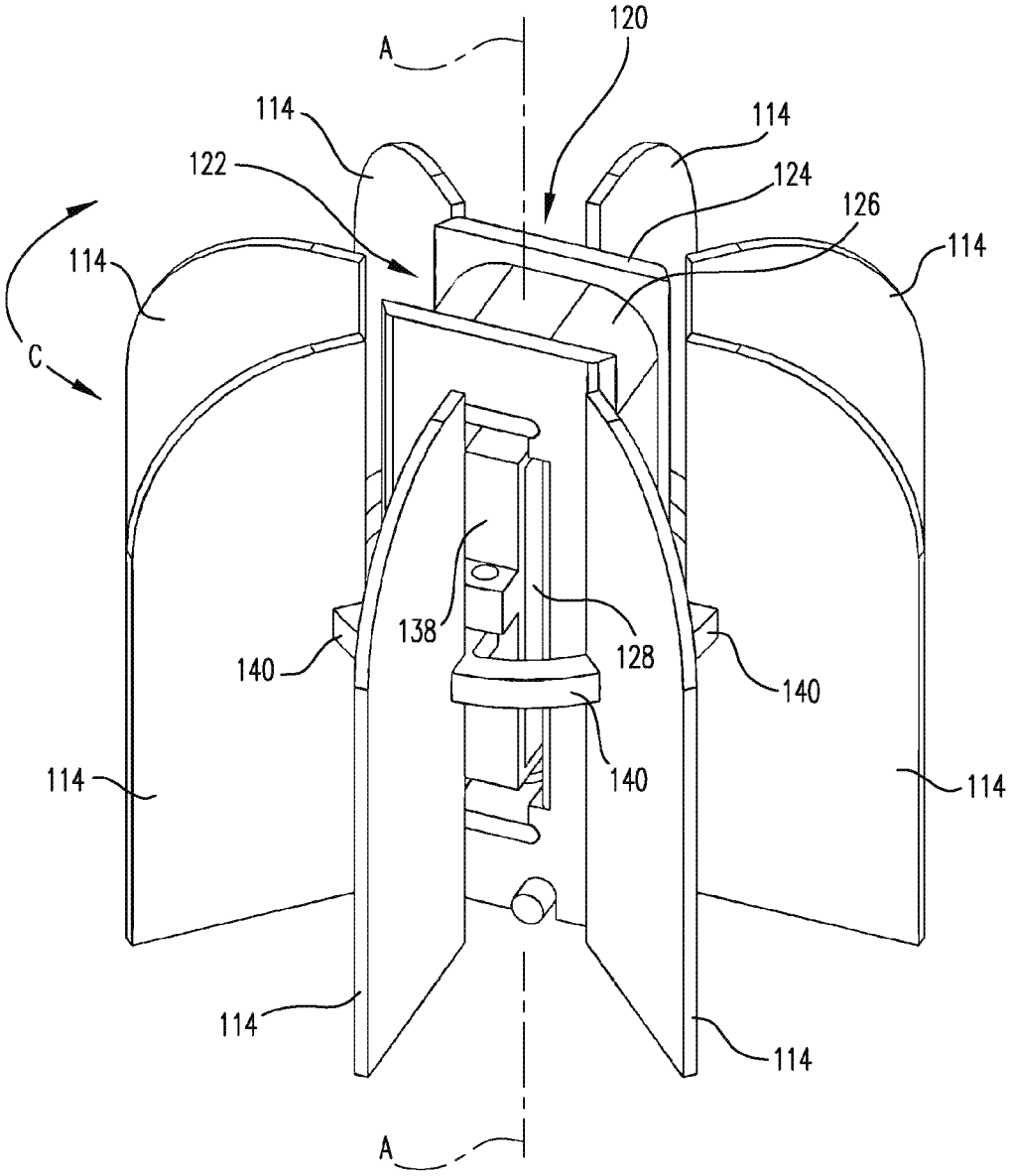
FIG. 5 is a perspective view of the exemplary active cooling device of FIG. 1.
Figure 6:
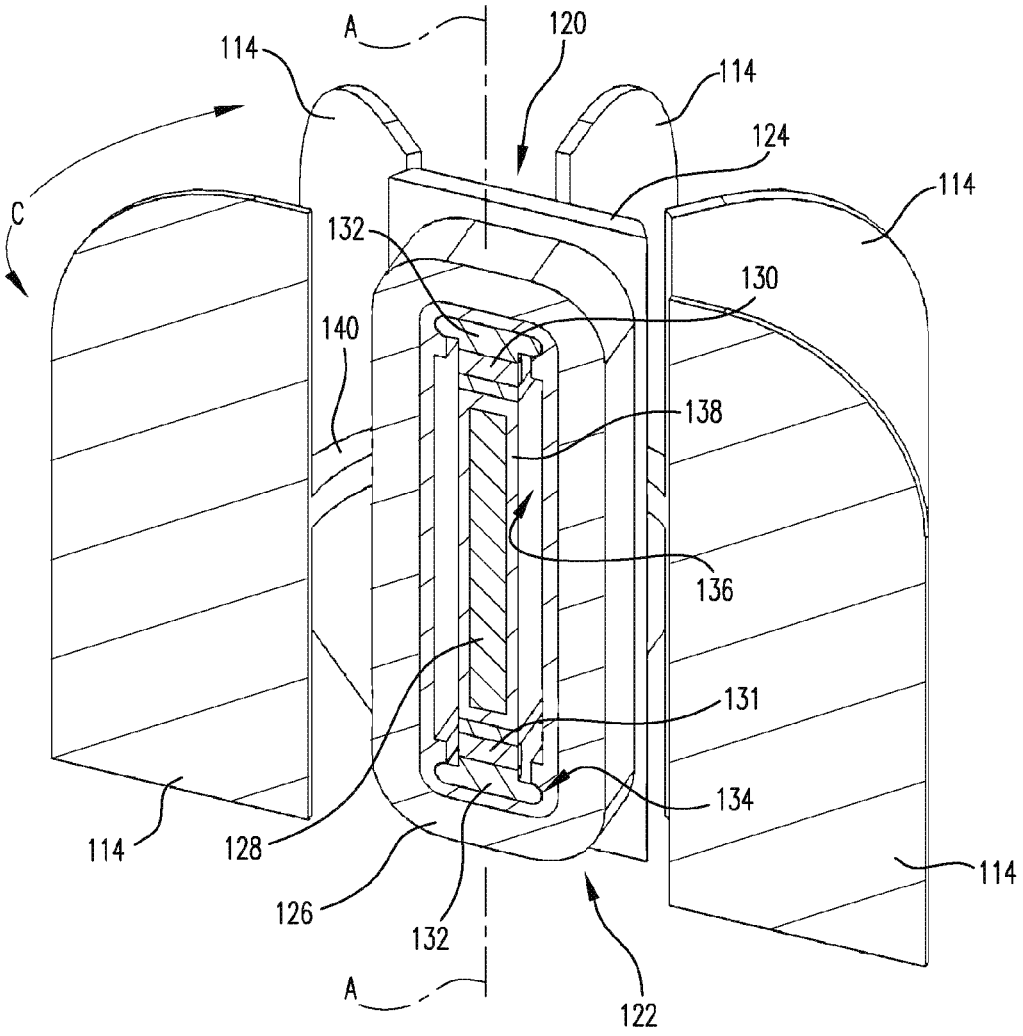
FIG. 6 is a cross-sectional and perspective view of the exemplary active cooling device of FIGS. 1 and 5.
Figure 7:
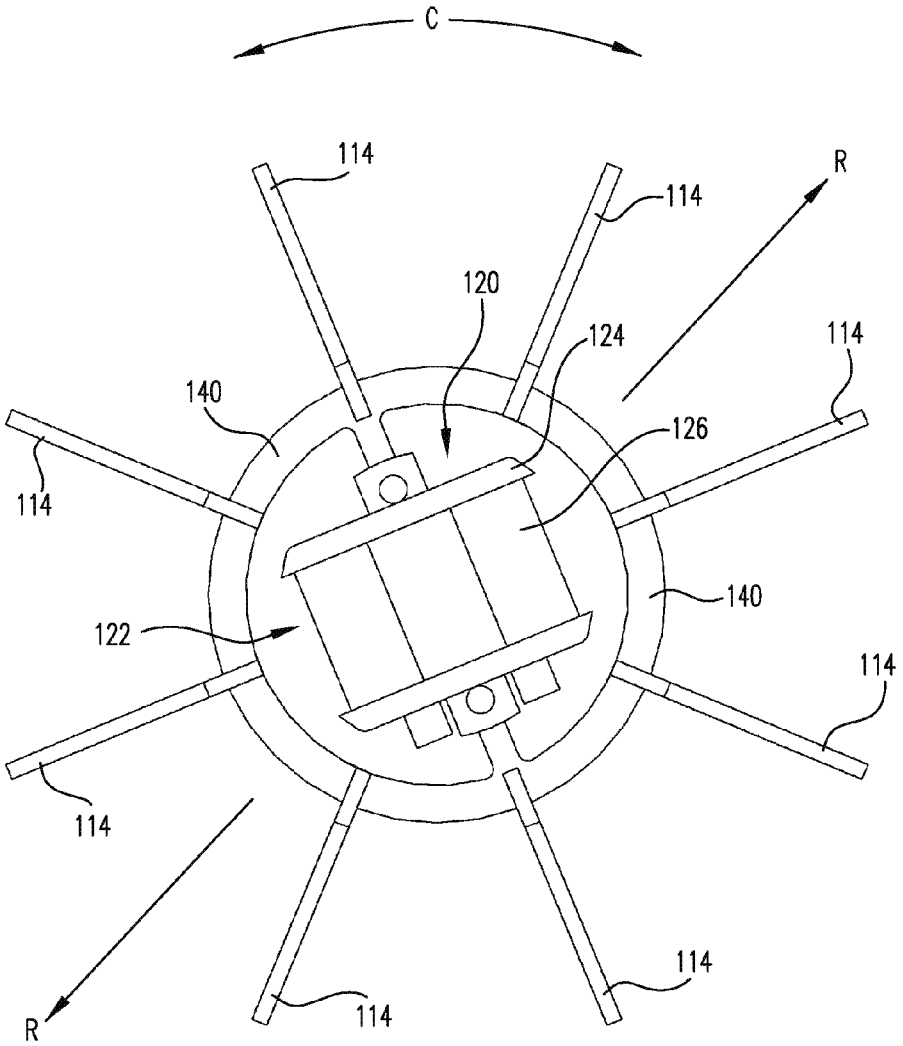
FIG. 7. is a top view of the exemplary active cooling device of FIGS. 1 and 5.

As shown in FIGS. 1, 3, and 4, housing 102 defines a plurality of chambers 116 formed by walls 117 that extend along radial direction R from an internal compartment 142. Chambers 116 are positioned adjacent to each other along circumferential direction C. Each chamber 116 defines at least two openings 118 for a flow of air—into and out of—each chamber 116 as will be further described. With proper positioning to create the air flow desired, more than two openings 118 may be used with each chamber to provide e.g., a larger flow of air in and out of each chamber or to provide further distribution of the direction of air flow.

As shown in FIGS. 3 and 4, active cooling device 101 also includes a plurality of movable fins 114. At least one fin 114 is positioned in each chamber 116. For this exemplary embodiment, fins 114 extend linearly along radial direction R as best seen in FIG. 4. However, other shapes such as e.g., arcs may be used for fins 114 as well. The plurality of fins 114 move together as each is connected with, and carried by, a fin support element or ring 140 that extends about circumferential direction C. Ring 140 is connected with a magnet housing 138. Other mechanisms may be used to connect fins 114 together as well.

Referring specifically now to FIG. 4, fins 114 are oscillated along circumferential direction C and about axis of rotation A-A by an oscillating device 120, which is located radially inward of fins 114 and at least partially within an internal compartment 142 (FIG. 1) of housing 102. For example, in a first phase, oscillating device 120 causes fins 114 to rotate circumferentially in the direction indicated by arrows S (counter-clockwise in FIG. 4) and about axis of rotation A-A. As a result, a jet of air flows out of each chamber 116 though one of the openings 118 as indicated by arrows O and, simultaneously, air flows into each chamber through one of the other openings 118 as indicated by arrow I. Conversely, in a second phase, oscillating device 120 causes fins 114 to rotate circumferentially in a direction opposite to that indicated by arrows S and about axis of rotation A-A. As a result, the flow of air through openings 118 will be reversed so as to provide a jet of air out of each chamber 116 through openings 118 that previously received air into chamber 116 during the first phase. Similarly, in this second phase, air is drawn into each chamber 116 through openings 118 that previously jettisoned air out of chamber 116 during the first phase.

By using the oscillating device 120 to provide a cyclic movement of fins 114 between the first and second phases, active cooling device 101 cools housing 102 and, therefore, lamp 100 or another electronic device in which it is configured. The frequency of oscillation between the first and second phases can be controlled to determine the level of cooling desired.

Fins 114 can be constructed to have profile that closely matches the cross-sectional shape of chamber 116. For example, as shown in FIG. 4, only a small gap 144 is provided between fin 114 and housing 102 so as to maximize the displacement or air as fins 114 are oscillated between the first and second phases by oscillating device 120.

Referring now to FIGS. 5, 6, 7, and 8, for this exemplary embodiment of active cooling device 101, oscillating device 120 includes a magnetic field generator 122 positioned at least partially within the internal compartment 142 formed by housing 102 and located radially inward of the plurality of fins 114. At least one magnet 128, located within magnet housing 138, is positioned within the magnetic field provided by field generator 122 when activated. Magnetic field generator 122 includes a bobbin 124 about which a plurality of wires or coils 126 are wrapped. By manipulating the current flowing through coils 126, the magnetic field provided by generator 122 can be controlled and, more importantly, changed in an alternating fashion to create the oscillating movement of fins 114. For example, an electronic driver or other power device, (not shown) can be positioned in e.g., lower lamp housing 110 (which is different from housing 102 that is used as a heat sink). with base 112 and connected with an external power source so that the driver can provide a controlled current to coils 126. Manipulation of such current by the driver can be used to change the direction of the magnetic field of field generator 122 in a cyclic manner. In turn, magnet 128 will react in a cyclic manner by oscillating—i.e. rotating back and forth about axis A-A so as to simultaneously oscillate fins 114 within chambers 116.

Figure 8:
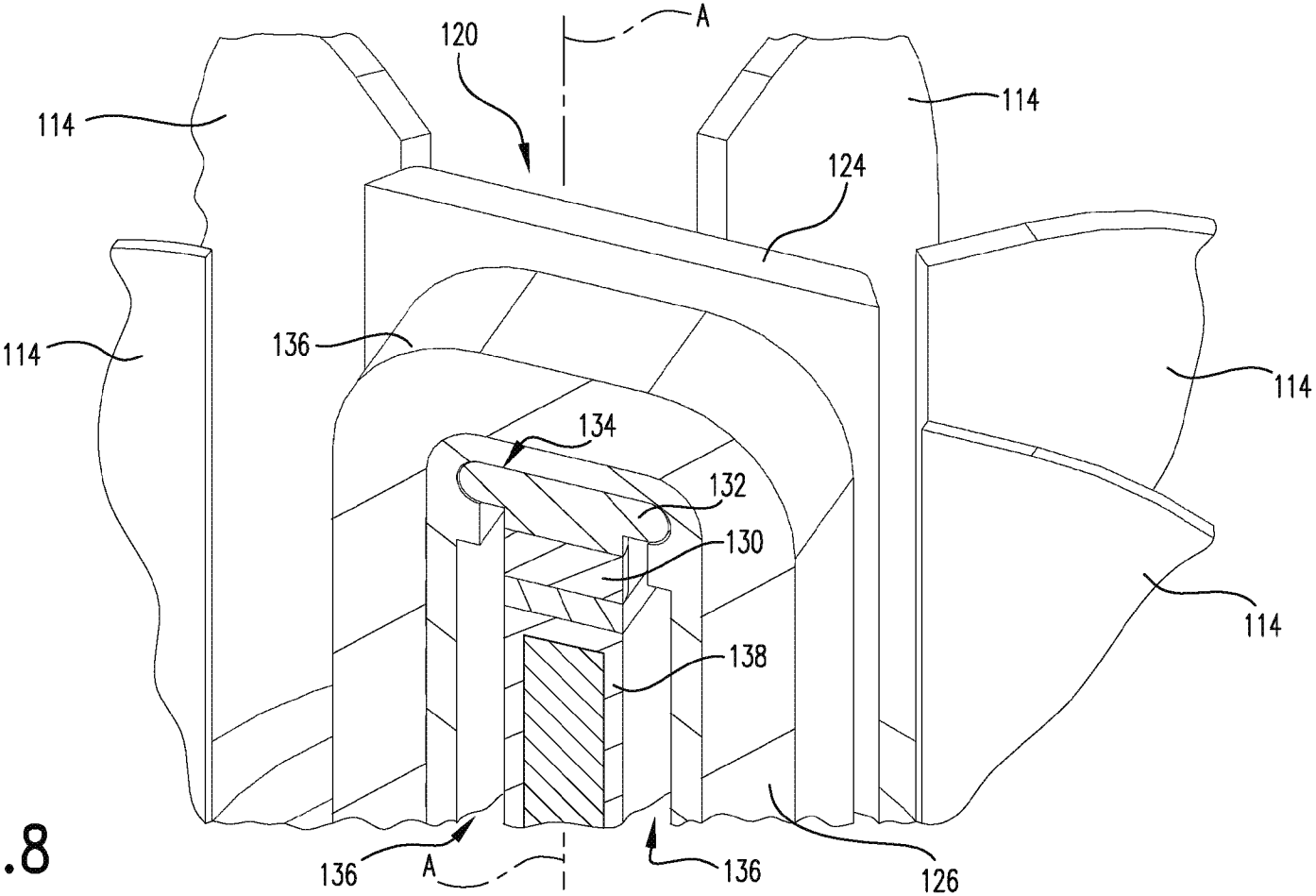
FIG. 8 provides a close-up, cross-sectional and perspective view of the top portion of the exemplary active cooling device from FIG. 6.

A pair of torsional elements 130 and 131 are positioned at opposing ends of magnet 128 along the axis of rotation A-A. The torsional elements 130 and 131 are connected between the bobbin 124 and the magnet housing 138 and rotatably support or suspend the magnet 128 within the magnetic field created by magnetic field generator 122. Referring to FIG. 8, for example, torsional element 130 is connected to a key 132 that is slidably received into a channel 134 formed in bobbin 124—a construction which simplifies the manufacture of torsional element 130. Key 132 and channel 134 are provided by way of example only. Other constructions for supporting magnet 128 within the magnetic field provided by generator 122 while still allowing magnet 128 to rotate about axis A-A may be used as well.

A variety of components may be used for torsional elements 130 and 131. In one exemplary embodiment, torsional elements 130 and 131 act as bearings that allow the free rotation of magnet 128 about axis A-A. In such an embodiment, torsional elements 130 and 131 do not assist in causing magnet 128 to rotate. Instead, magnet 128 rotates only under the effects of the magnetic field created by generator 122.

In another embodiment, torsional elements 130 and 131 are constructed from a spring or spring-like element such as wound metal coils or a resilient material, e.g., resilient silicone. For this construction, torsional elements 130 and 131 provide for storing and releasing energy during the oscillation of magnet 128 and, therefore, oscillation of fins 114 about axis A-A as generator 122 creates a cyclic, magnetic field.

For example, in the position shown in FIG. 4, fins 114 are in a neutral position midway between the opposing walls 117 that form chambers 116. In this neutral position, torsional elements 130 and 131 are configured so as to provide no torque that would urge magnet 128 to rotate. However, as the magnetic field causes the magnet 128 to rotate in the direction of arrow S so that each fin 114 moves towards a wall 117 in chamber 116 in the first phase, torsional elements 130 and 131 are wound or otherwise caused to store potential energy. As the magnetic field is changed by generator 122 so as to cause magnet 128 and fins 114 to rotate in the opposite direction from arrow S in the second phase, this potential energy is released as torsional elements 130 and 131 apply a restorative torque and assist in causing such rotation. After fins 114 pass through the neutral position shown in FIG. 4 and move towards an opposing wall 117 in chamber 116, torsional elements 130 and 131 again store potential energy as part of the repeated cycle between the first and second phases. While a variety of configurations may be used, in certain embodiments the current through coils 126 is varied according to the natural frequency of the oscillating device 120 and fins 114.

Figure 9:
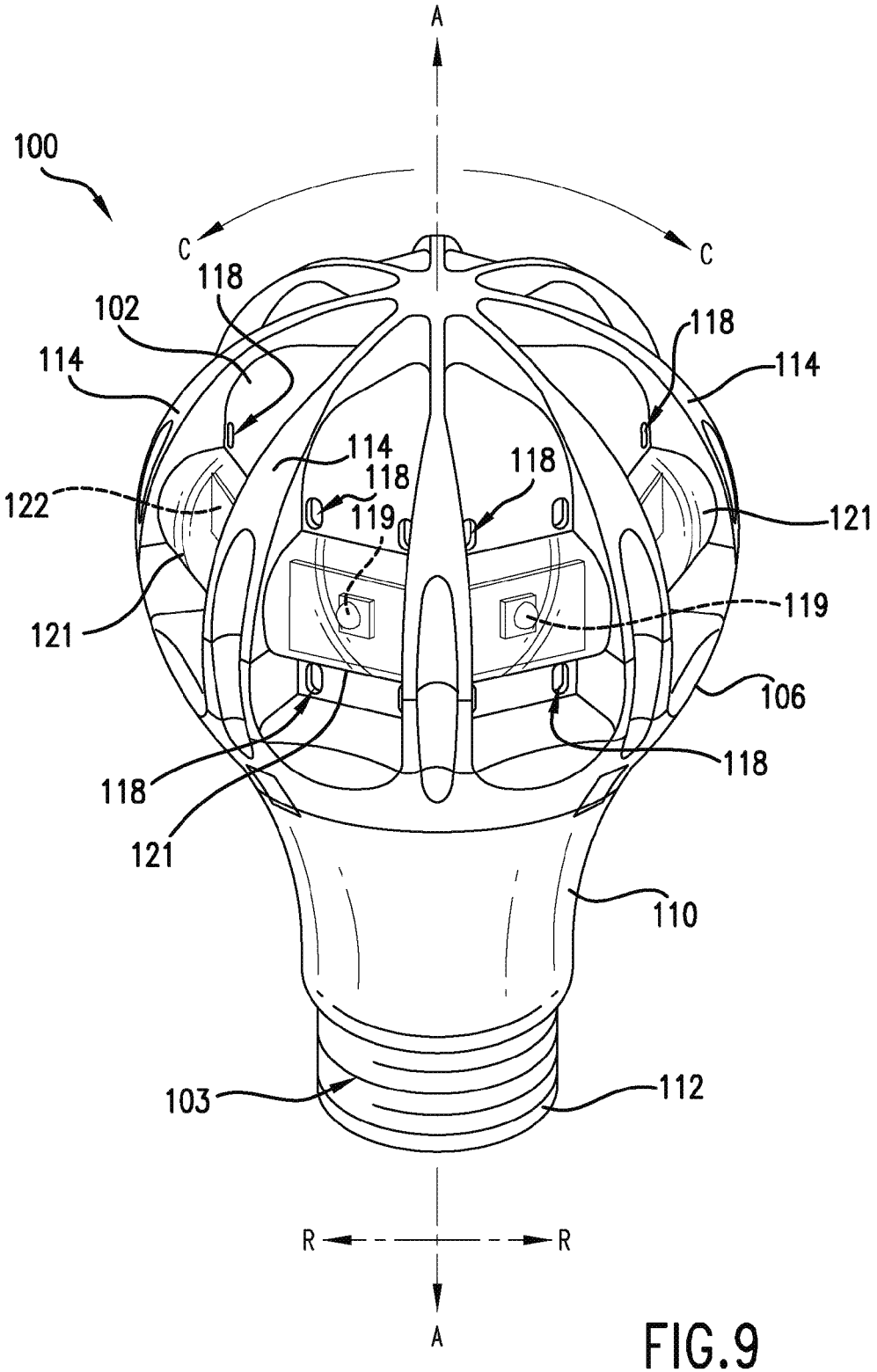
FIG. 9 is a perspective view of an exemplary lamp assembly of the present invention incorporated with an exemplary active cooling device.

FIG. 9 provides another exemplary embodiment of lamp 100 of the present invention that may be equipped with an active cooling device such as that described above. Lamp 100 includes a lower lamp housing 110 connected with a lamp base 112. As shown, base 112 includes threads 103 for connection into a conventional socket to provide electrical power to operate lamp 100.

Lamp 100 includes a heat sink in the form of housing 102, which is constructed from an upper portion 104 and a lower portion 106 in a manner similar to the embodiments of FIGS. 1-8. Housing 102 also includes a plurality of stationary fins 108 for dissipating heat away from the lamp and particularly away from a plurality of light emitting elements 119. For this exemplary embodiment, stationary fins 108 extend along axial direction A and are spaced apart from each other along circumferential direction C.

Heat sink housing 102 includes an active cooling device in a manner previously described so as to create a flow of air through a plurality of openings 118 that are spaced apart along circumferential direction C with some openings 118 at different locations along axial direction defined by axis of rotation A-A. Openings 118 allow for a flow of air between the inside of housing 102 and the environment external to housing 102. For example, air may flow into, or out of, housing 102 through openings 118, as previously described. With this exemplary embodiment, openings 118 are spaced apart on both axial sides of light emitting elements 119—i.e. they may be both above and below light emitting elements 119 when lamp 100 is oriented as shown in FIG. 9. Additionally, openings 118 are also positioned so as to cause air—e.g., jets of air—moving therethrough to flow along fins 114 for purposes of improving heat exchange. This air flow may include air that actually passes through opening 118 as well as air that is entrained therein. Other configurations, including different shapes and locations, may be used for openings 118 as well.

Heat sink housing 102 may be constructed from a variety of high thermal conductivity materials that will promote the transfer of heat from the thermal load provided by light emitting elements 119 to the ambient environment and thereby reduce the temperature rise that would otherwise result from the thermal load. Exemplary materials can include metallic materials such as alloy steel, cast aluminum, extruded aluminum, and copper, or the like. Other materials can include engineered composite materials such as thermally-conductive polymers as well as plastics, plastic composites, ceramics, ceramic composite materials, nanomaterials, such as carbon nanotubes (CNT) or CNT composites. Other configurations may include a plastic heat sink body comprising a thermally conductive (e.g., copper) layer disposed thereupon, such as disclosed in US Patent Publication 2011-0242816, hereby incorporated by reference. Exemplary materials can exhibit thermal conductivities of about 50 W/m-K, from about 80 W/m-K to about 100 W/m-K, 170 W/m-K, 390 W/m-K; or, from about 1 W/m-K to about 50 W/m-K.

As stated above, lamp 100 includes a plurality of light emitting elements 119 that are positioned about heat sink 102 and are spaced apart along the circumferential direction C. The embodiment illustrated includes eight LEDs spaced apart circumferentially about the periphery of heat sink 102. Other numbers of LEDs may be used as well including, for example, six and seven. In addition, other types of light emitting elements 119 other than LED-based elements may be used.

A plurality of optical elements 121 are positioned over the LEDs 118. Optical elements 121 receive light from LEDs 119 and help distribute the same. As used herein, the term "optical elements" may generally refer to one or more of diffusers, reflectors, and/or any associated light management elements such as e.g., lenses; or combinations thereof; or the like. For example, optical elements 121 may be constructed as diffusers that are made from materials (glass, polymers such as polycarbonates, or others) that help scatter light received from LEDs. Again, the lamp of FIG. 9 is provided by way of example only. The active cooling device of the present invention may be used with lamps of other configurations as well as with other electronic devices.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An active cooling device, the active cooling device defining radial and circumferential directions, the active cooling device comprising:

a plurality of fins spaced apart from each other along a circumferential direction of the cooling device and rotatable about an axis of rotation;

a housing defining a plurality of chambers positioned adjacent to each other along the circumferential direction, each of the plurality of chambers formed at least in part by opposing walls that extend along the radial direction, each chamber defining at least two openings for air flow in and out of the chamber, wherein at least one fin from the plurality of fins is movably positioned within each chamber; and an oscillating device positioned at least partially within the housing and radially inward of the plurality of fins, the plurality of fins connected with the oscillating device, the oscillating device structured for causing the plurality of fins to rotate back and forth along the circumferential direction so as to create air flow through the openings in each chamber;

the device further comprising a plurality of light emitting devices supported by the housing and positioned outside of the plurality of chambers of the housing, wherein the at least two openings are spaced apart on sides of light emitting devices.

2. The active cooling device as in claim 1, wherein the oscillating device further comprises:

a magnetic field generator; and a magnet positioned within a magnetic field provided by the magnetic field generator and configured for rotating along the circumferential direction about the axis of rotation; and a torsional element supporting the magnet within the magnetic field, the torsional element configured for applying a restorative torque to the magnet along the circumferential direction about the axis of rotation.

3. The active cooling device as in claim 1, wherein the oscillating device further comprises:

a bobbin defining an interior space;

a coil wrapped around the bobbin and configured for creating a magnetic field;

at least one magnet positioned within the interior space and configured for rotating along the circumferential direction about the axis of rotation, wherein the plurality of fins are configured to rotate with the at least one magnet;

a pair of torsional elements positioned at opposing ends of the least one magnet and positioned along the axis of rotation, the torsional elements connected between the bobbin and the magnet so as to suspend the magnet within the bobbin.

4. The active cooling device as in claim 3, wherein the pair of torsional elements each comprises a spring or spring-like element configured for storing and releasing potential energy as the magnet is rotated back and forth about the axis of rotation.

5. The active cooling device as in claim 3, further comprising a magnet housing into which the at least one magnet is received, wherein the pair of torsional elements are connected to the magnet housing.

6. The active cooling device as in claim 5, further comprising a ring extending about the circumferential direction and attached to the magnet housing, wherein the plurality of fins are attached to the ring.

7. The active cooling device as in claim 1, wherein the at least two openings of each chamber are spaced apart from each other along the circumferential direction and positioned relative to the fin in each chamber such that the direction of air flow alternates between the at least two openings as the plurality of fins are rotated back and forth.

8. The active cooling device as in claim 1, wherein each fin extends linearly along the radial direction.

9. The active cooling device as in claim 1, wherein the housing comprises a heat sink for an electronic device.

10. The active cooling device as in claim 1, wherein the plurality of light emitting devices comprise a plurality of LEDs spaced apart along the circumferential direction.

11. A lamp comprising the active cooling device of claim 1.

12. An active cooling device, comprising:

a housing defining an internal compartment and a plurality of chambers positioned proximate to each other along a circumferential direction, the plurality of chambers positioned radially outward of the internal compartment, each of the plurality of chambers formed at least in part by opposing walls that extend along a radial direction, each chamber of the plurality of chambers having at least two openings spaced apart from each other along the circumferential direction;

a plurality of fins mechanically connected to each other, each fin positioned in one of the plurality of chambers, the plurality of fins rotatable within the plurality of chambers and about an axis of rotation so as to create a flow of air through the at least two openings; and an oscillating device positioned at least partially within the internal compartment of the housing and radially inward of the plurality of fins, the plurality of fins connected with the oscillating device, the oscillating device structured for causing the plurality of fins to rotate back and forth along the circumferential direction so as to create air flow through the openings in each chamber; the device further comprising a plurality of light emitting devices supported by the housing and positioned outside of the plurality of chambers of the housing, wherein the at least two openings are spaced apart on sides of light emitting devices.

13. The active cooling device as in claim 12, wherein the oscillating device further comprises:

a bobbin defining an interior space;

a coil wrapped around the bobbin and configured for creating a magnetic field;

at least one magnet positioned within the interior space and configured for rotating along the circumferential direction about the axis of rotation, wherein the plurality of fins are configured to rotate with the at least one magnet; and a pair of torsional elements positioned at opposing ends of the least one magnet and positioned along the axis of rotation, the torsional elements connected between the bobbin and the magnet so as to suspend the magnet within the bobbin.

14. The active cooling device as in claim 12, wherein the oscillating device further comprises:

a magnetic field generator; and a magnet positioned within the magnetic field provided by the magnetic field generator and configured for rotating along the circumferential direction about the axis of rotation; and a torsional element supporting the magnet within the magnetic field, the torsional element configured for rotation along the circumferential direction about the axis of rotation.

15. The active cooling device as in claim 14, wherein the torsional element comprises a spring or spring-like element configured for storing and releasing potential energy as the magnet is rotated back and forth about the axis of rotation.

16. The active cooling device as in claim 14, further comprising a magnet housing into which the at least one magnet is received, wherein the torsional element is connected to the magnet housing.

17. The active cooling device as in claim 14, further comprising a fin support element extending about the circumferential direction and attached to the magnet housing, wherein the plurality of fins are attached to the fin support element.

18. The active cooling device as in claim 12, wherein the at least two openings of each chamber are spaced apart from each other along the circumferential direction and positioned relative to the fin in each chamber such that the direction of air flow alternates between the at least two openings as the plurality of fins are rotated back and forth.

19. A lamp comprising:

a plurality of LEDs; and an active cooling device;

wherein the active cooling device defines radial and circumferential directions, the active cooling device comprising:

a plurality of fins spaced apart from each other along a circumferential direction of the cooling device and rotatable about an axis of rotation;

a housing defining a plurality of chambers positioned adjacent to each other along the circumferential direction, each chamber defining at least two openings for air flow in and out of the chamber, wherein at least one fin from the plurality of fins is movably positioned within each chamber; and an oscillating device positioned at least partially within the housing and radially inward of the plurality of fins, the plurality of fins connected with the oscillating device, the oscillating device structured for causing the plurality of fins to rotate back and forth along the circumferential direction so as to create air flow through the openings in each chamber; and wherein the plurality of LEDs are supported by the housing and spaced apart along the circumferential direction and positioned outside of the plurality of chambers of the housing.

* * * * *